US008007883B2

(12) United States Patent
Dürr

(10) Patent No.: US 8,007,883 B2
(45) Date of Patent: Aug. 30, 2011

(54) CONTAINER COMPRISING A TRANSPARENT CYLINDRICAL CONTAINER WALL

(75) Inventor: Alain Dürr, Basel (CH)

(73) Assignee: Fisher Clinical Services AG, Allschwil (CH)

( * ) Notice: Subject to any disclaimer, the term of this patent is extended or adjusted under 35 U.S.C. 154(b) by 565 days.

(21) Appl. No.: 10/534,767

(22) PCT Filed: Dec. 15, 2003

(86) PCT No.: PCT/CH03/00817

§ 371 (c)(1),
(2), (4) Date: May 12, 2005

(87) PCT Pub. No.: WO2004/056668

PCT Pub. Date: Jul. 8, 2004

(65) Prior Publication Data

US 2006/0037928 A1 Feb. 23, 2006

(30) Foreign Application Priority Data

Dec. 19, 2002 (CH) ..... 2171/02

(51) Int. Cl.

| | |
|---|---|
| ***B65B 53/00*** | (2006.01) |
| ***B32B 27/20*** | (2006.01) |
| ***B65D 81/36*** | (2006.01) |
| ***B65D 8/18*** | (2006.01) |
| ***B65D 6/18*** | (2006.01) |

(52) U.S. Cl. ... 428/35.7; 428/35.1; 206/569; 220/23.91; 220/4.23; 220/4.24; 220/62.11; 220/62.22

(58) Field of Classification Search ..... 428/34.1; 62/327; 220/903, 23.91, 4.22, 4.23, 4.24, 220/592.24, 62.11, 62.22; 235/385; 604/406; 294/32, 33

See application file for complete search history.

(56) References Cited

U.S. PATENT DOCUMENTS

| | | | | |
|---|---|---|---|---|
| 3,912,100 | A | 10/1975 | Graham et al. | |
| 3,937,853 | A * | 2/1976 | Shank, Jr. | 427/461 |
| 3,955,020 | A * | 5/1976 | Cavanagh et al. | 428/34.7 |
| 3,965,920 | A | 6/1976 | deVial | |
| 4,051,265 | A * | 9/1977 | Kirshenbaum et al. | 426/107 |
| 4,205,750 | A * | 6/1980 | Dews | 206/534 |

(Continued)

FOREIGN PATENT DOCUMENTS

FR 2731210 9/1996

(Continued)

OTHER PUBLICATIONS http://dictionary.reference.com/browse/vial (Definition of Vial) 1996.*

(Continued)

*Primary Examiner* — Rena L Dye
*Assistant Examiner* — Erik Kashnikow
(74) *Attorney, Agent, or Firm* — Workman Nydegger

(57) ABSTRACT

The invention relates to a container (1) comprising a transparent cylindrical container wall (2) and an envelope (8) covering the entire container wall. Such containers are used in the form of a vial, an ampulla or a syringe, for example, in clinical tests of medicaments or remedies. According to the invention, the envelope is embodied in an opaque manner such that it can be determined whether undissolved particles are still present in the liquid, but the actual color of the content cannot be determined.

26 Claims, 1 Drawing Sheet

U.S. PATENT DOCUMENTS

Figure 1:
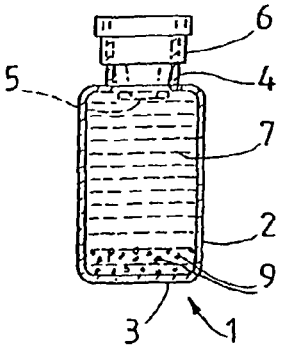

| | | | | |
|---|---|---|---|---|
| 4,281,520 | A * | 8/1981 | Norwood | 62/372 |
| 4,481,163 | A | 11/1984 | Negishi et al. | |
| 4,755,405 | A * | 7/1988 | Massucco et al. | 428/35.7 |
| 5,261,546 | A | 11/1993 | Van Der Grift | |
| 5,462,180 | A | 10/1995 | Bright | |
| 5,525,383 | A * | 6/1996 | Witkowski | 428/30 |
| 5,529,217 | A * | 6/1996 | Siegel | 222/131 |
| 2003/0021918 | A1 * | 1/2003 | McKillip | 428/34.1 |

FOREIGN PATENT DOCUMENTS

| | | |
|---|---|---|
| GB | 2025352 | 1/1980 |
| WO | WO0073167 | 12/2000 |
| WO | WO0187722 | 11/2001 |

OTHER PUBLICATIONS

Machine Translation of FR 2731210 Sep. 1996.*

* cited by examiner

CONTAINER COMPRISING A TRANSPARENT CYLINDRICAL CONTAINER WALL

In medicine the problem of quality assurance, thus knowledge about effects and side effects of therapeutics, becomes more and more important. That is why these effects are established and verified in clinical trials by means of statistical tests.

In such trials a large number of subjects receive orally, parenterally or topically the to-be-tested medicine over a period of time set in advance and according to a special protocol, and the reactions of the subjects and the effects of the medicines are registered and statistically evaluated.

Statistically significant evaluations of clinical trials require now that in a series of tests, various preparations and/or their formulations and/or concentrations are used, for example, in a predetermined order and that these, independent of their original packaging, their colour, their original labelling or the like have a uniform appearance so that their characteristics cannot be distinguished neither by the subjects nor other persons involved in carrying out the tests.

Besides the generally known, blisterlike push-out packagings containing pills or dragées which are used, among other things, for the above-mentioned purpose, there are still other galenic forms of administration, for example, as liquid which are presented to the subjects in syringes and ampoules as well as lyophilsates, thus freeze-dried substances which are kept in vials and then are dissolved again for the application in a liquid delivered by means of a syringe in order that they can be administered orally or by injection. Also such forms of administration are used increasingly for the clinical trial where in these applications the to-be-tested medicines as well as the control and comparison preparations required likewise for the statistical evaluation are each contained in a sealed container thus, for example, a vial, an ampoule or syringe.

The object of the invention is now to propose for the use of liquid or freeze-dried galenic administration, a novel container which takes into account the anonymity requirements/blinding in such tests.

The subject-matter of the invention is thus a container usable for this purpose which can be designed as vial, ampoule or disposable syringe as well as a set of several such containers.

Advantageous embodiments of the invention are subject-matter of the claims.

Transparent containers with a jacket more or less covering the container wall are in themselves known: Thus, for example, FR 2 731 210 A shows an obviously commercial beverage bottle with a glued on jacket which has insulating as well as aesthetic functions and moreover makes the bottle, on the one hand, somewhat more damage resistant and, on the other hand, holds together the fragments in case of damage. This previously known jacket is translucent, however, obviously not so that with it the colour of the bottle contents can be made unrecognizable since particularly for beverage bottles it is not unimportant to be able to establish the colour of the contents.

Also U.S. Pat. No. 3,955,920 shows a beverage bottle with a stuck on, in some cases multi-layered jacket consisting of synthetic material which serves the purpose of protecting the bottle against breakage and, in case of breakage, to hold together the fragments. In contrast to this, U.S. Pat. No. 5,261,546 shows now a glass bottle for pharmaceutical liquids. However, in significant distinction to the container according to the present invention, this has a jacket with an opening serving especially for the exact control of the contents.

In the following an exemplified embodiment of the invention is elucidated further with the aid of the drawing. In the drawing FIG. 1 shows a container, drawn partly in section, partly in view, containing a liquid, FIG. 2 shows a view of a jacket made of synthetic material in the opened-up state, that is, before it is put on the container, FIG. 3 shows a view in the direction of arrow III of FIG. 2, FIG. 4 shows a view of the container with put-on synthetic jacket in which case some parts are cut away, and FIG. 5 shows a set of five identical containers according to FIG. 4 in which case each container can have different contents.

The cylindrical container shown in FIGS. 1, 4 and 5, and designated as a whole by 1, called vial in the following, has a transparent, for example, clear glass or synthetic material wall 2 with a bottom 3 and a stopper 5 lodged firmly, detachably or undetachably in the bottleneck 4, with accompanying cap 6. The cap 6 is in this case designed and dimensioned in such a way that in the secured state it protrudes over the edge of the filling opening, here, in the present example, over the bottleneck 4. The vial 1 contains a liquid or freeze-dried, thus solid or liquid galenic formulation 7 in which case the latter, during the dissolution in a liquid, still can contain soluble particles 9.

Figure 4:
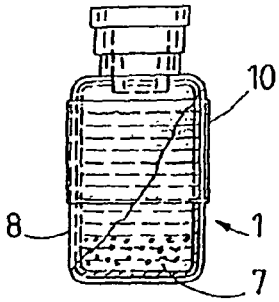
Figure 5:
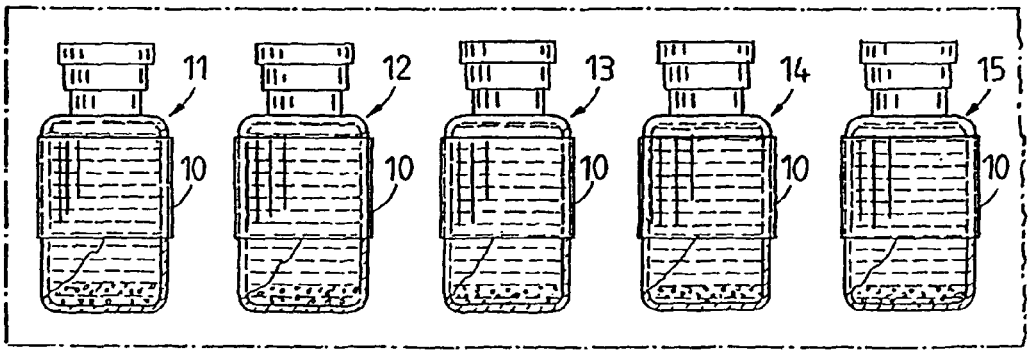

According to the invention, the vial now, as is apparent from FIG. 4, has a jacket 8 covering the entire container wall. This jacket consists preferably of coloured, thermally formable synthetic material, thus, for example, a PVC or a polyethylene. Important and essential is that the colour of this jacket is selected in such a way that two containers which are filled with different contents take on the same appearance in which case, however, the intensity of this colour may only be so strong that the transparency through the container wall only is reduced to the extent that it still can be established whether undissolved particles are present in the liquid.

Figure 2:
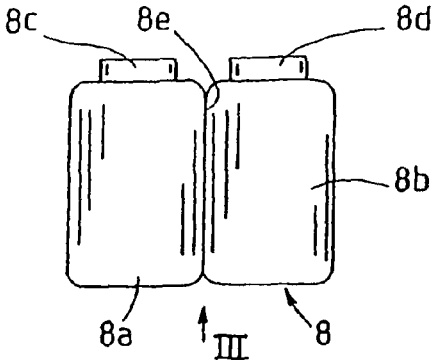
Figure 3:
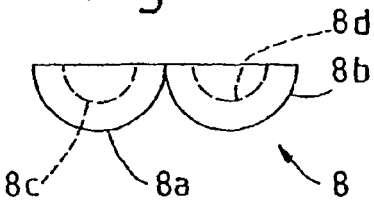

Such jackets are suitably made with the deep drawing process in such a way that first, by means of a single or multiple tool, several synthetic material jackets, one which is shown in FIGS. 2 and 3, are produced in a PVC film. Afterwards, these are punched out of the film so that each jacket comprises two identical half shells 8*a* and 8*b*, connected hinged to one another along a generatrix 8*e*, of which the inside surfaces correspond exactly to the form of the vial 1, which thus each also have a neck part 8*c* and 8*d* respectively as well as a bottom part.

After this jacket 8, comprising two half shells, have been put around the vial according to FIG. 1, its two parts are covered and kept together by placing a safety sealing tape 10 enclosing them. As safety sealing tape one uses suitably a synthetic material tape, coated on one side with adhesive, with scored separating lines which serve to destroy the tape when removed so that a reattachment becomes impossible. This sealing tape can be colourless or coloured. Suitably its surface not provided with the adhesive, thus the exterior surface, is structured in such a way that it can be printed on or written on. If the surface available for the accommodation of multilingual information is too small, a paper or synthetic material tape, enclosing the container once or repeatedly, can also be used of which one end is attached to the container by means of an adhesive and of which the other end is provided, if necessary, with a repeatedly usable adhesive.

It is, of course, also possible to attach the jacket undetachably to the container by means of an adhesive.

FIG. 5 shows now a set of five identically looking vials 11-15 according to FIG. 4. Each of these five vials has, however, different contents in which case in some there are still undissolved particles. The translucency of the five jackets now is such that the presence of still undissolved particles but not a difference in colour of the contents of the various vials can be detected.

Although in the above exemplified embodiment the container is described as a vial, the container also can be of a different design, for example, ampoule or injection syringe.

The invention claimed is:

1. A container comprising:

a transparent, cylindrical container wall which includes and extends between a container neck and a container bottom; and a jacket comprising a first half shell and a second half shell which are each preformed from a thin film material with an inner surface extending between a first edge and a spaced apart second edge, each inner surface corresponding to a shape of the container wall, including the container bottom and the container neck, the first and second half shells being hingedly connected together along a generatrix, wherein the generatrix defines a line along which the first edge of the first half shell and the first edge of the second half shell are maintained in direct contact, the jacket being hingeable about the generatrix between an open position in which the second edge of the first half shell is spaced apart from the second edge of the second half shell, and a closed position in which the second edge of the first half shell is adjacent to or in direct contact with the second edge of the second half shell, the first and second half shells retaining their respective three-dimensional shapes when the jacket is in the open and closed positions, the jacket covering the entire container wall in the closed position, including at least a portion of the container neck and at least a portion of the container bottom, the container containing a liquid or freeze-dried galenic formulation wherein the jacket is comprised of a material that has a transparency that allows a determination to be made as to whether solid particles or a liquid or a liquid with still undissolved particles are disposed within the container while preventing the actual colour of the contents to be determined when viewing the contents through the jacket.

2. A container according to claim 1, wherein the jacket consists of coloured material.

3. A container according to claim 1, wherein the jacket comprises a thermally formable synthetic material.

4. A container according to claim 1, wherein the jacket comprises a preformed synthetic material jacket lying fully against the container wall in the closed position.

5. A container according to claim 1, wherein the two half shells are kept together when the jacket is in the closed position by a safety sealing tape enclosing the half shells.

6. A container according to claim 5, wherein the safety sealing tape can be written on or that on the safety sealing tape a printed or writeable label can be placed.

7. A container according to claim 1, wherein the half shells are unable to be detached from the container wall once positioned therearound.

8. A set of containers, comprising a plurality of containers, each container having a transparent cylindrical container wall which includes and extends between a container neck and a container bottom, and a jacket covering the entire container wall and containing a liquid or freeze-dried galenic formulation, wherein each jacket is comprised of a first half shell and a second half shell which are each preformed from a thin film material with an inner surface extending between a first edge and a spaced apart second edge, each inner surface corresponding to an exact shape of the container wall, the first and second half shells being hingedly connected together along a generatrix, wherein the generatrix defines a line along which the first edge of the first half shell and the first edge of the second half shell are maintained in direct contact, each jacket being hingeable about the generatrix between an open position in which the second edge of the first half shell is spaced apart from a second edge of the second half shell, and a closed position in which the second edge of the first half shell is adjacent to or in direct contact with the second edge of the second half shell, the first and second half shells retaining their respective three-dimensional shapes when the jacket is in the open and closed positions, wherein each jacket is also comprised of a material with a transparency that allows a determination to be made as to whether solid particles, or a liquid, or a liquid with still undissolved particles are disposed within the container while preventing the actual colour of the contents to be determined when viewing the contents through the jacket, wherein not all containers have the same contents, and wherein all containers are provided with an identical jacket, and all containers can only be distinguished from one another by lettering or numbering.

9. A container according to claim 1, wherein the container comprises a vial, an ampoule, or a syringe.

10. A container according to claim 1, wherein the liquid or freeze-dried galenic formulation comprises a medicine.

11. A container according to claim 5, wherein the safety sealing tape completely encircles the container.

12. A jacket comprising first and second half shells which are preformed together from a thin film material, the first and second half shells each having a first edge and a spaced apart second edge, the first and second half shells being hingedly connected to each other along an entire length of a generatrix which defines a line along which the first edge of the first half shell and the first edge of the second half shell are maintained in direct contact, the jacket being hingeable about the generatrix between an open position in which the second edge of the first half shell is spaced apart from the second edge of the second half shell, and a closed position in which the second edge of the first half shell is adjacent to or in direct contact with the second edge of the second half shell, the first and second half shells retaining their respective three-dimensional shapes when the jacket is in the open and closed positions, the jacket being configured to be removably put around a transparent container containing a liquid or freeze-dried galenic formulation so as to entirely cover the container when in the closed position, the jacket being comprised of a colored material transparency that causes different colored contents in a container covered by the jacket to be indistinguishable based on color while allowing undissolved particles within the container to be visable when viewed through the jacket.

13. A jacket according to claim 12, wherein the jacket is comprised of a thermally formable synthetic material.

14. A jacket according to claim 12, wherein the half shells are preformed to correspond to the form of the container when the jacket is in the open and closed positions for lying fully against the container wall when the jacket is in the closed position.

15. A jacket according to claim 12, wherein the two half shells are kept together by a safety sealing tape enclosing the half shells when the jacket is in the closed position.

16. A jacket according to claim 15, wherein the sealing tape can be written on.

17. A jacket according to claim 15, wherein the sealing tape includes a printed or written label.

18. The container recited in claim 1, wherein the container wall has a side that extends an entire length between the container neck and the container bottom and wherein a length of the generatrix is substantially the same as the entire length of the side of the container wall.

19. The container recited in claim 1, wherein the jacket also includes a preformed neck portion which protrudes away from the first and second half shells and away from the container bottom and which extends up around the entire container neck when the jacket is in the closed position.

20. The container recited in claim 5, wherein the jacket is affixed to the container without the use of any adhesive between the jacket and the container when the jacket is in the closed position, the first and second half shells being held in place about the container wall by the safety sealing tape.

21. The container recited in claim 5, wherein the safety sealing tape is a colored tape.

22. The container recited in claim 1, wherein the jacket and a hinge disposed along the generatrix, which hingedly connects first and second half shells together, are composed of a same material.

23. The jacket recited in claim 12, wherein the first and second half shell of the jacket each comprise:

a preformed side wall;

a preformed neck portion; and a preformed shoulder portion, wherein the shoulder portion arcuately extends between and connects the preformed neck portion and the preformed side wall, the preformed side wall, preformed neck portion, and preformed shoulder portion collectively having a same shape when the jacket is in the open and closed positions.

24. The jacket recited in claim 12, wherein the jacket is preformed during a deep drawing process out of a plastic film.

25. The container recited in claim 1, wherein the inside surfaces of the first and second half shells correspond to the form of the container wall when the jacket is in the open position.

26. The jacket recited in claim 12, wherein the first and second half shells are substantially identical.

* * * * *